United States Patent [19]

Yamaryo

[11] Patent Number: 4,848,206

[45] Date of Patent: Jul. 18, 1989

[54] KEY MECHANISM FOR A BASS RANGE CLARINET

[75] Inventor: Shigeru Yamaryo, Hamamatsu, Japan

[73] Assignee: Yamaha Corporation, Japan

[21] Appl. No.: 164,804

[22] Filed: Mar. 7, 1988

[30] Foreign Application Priority Data

Mar. 13, 1987 [JP] Japan ..... 62-058589
Mar. 13, 1987 [JP] Japan ..... 62-036728

[51] Int. Cl.[4] ..... G10D 7/06
[52] U.S. Cl. ..... 84/382; 84/385 P
[58] Field of Search ..... 84/382, 385 P, 380 R, 84/380 A, 381, 384, 385 R

[56] References Cited

U.S. PATENT DOCUMENTS 2,759,386 8/1956 Pascucci ..... 84/385 P X
2,951,414 9/1960 Christensen ..... 84/382
4,508,004 4/1985 Pages ..... 84/385 P

*Primary Examiner*—L. T. Hix
*Assistant Examiner*—Brian W. Brown
*Attorney, Agent, or Firm*—Lerner, David, Littenberg, Krumholz & Mentlik

[57] ABSTRACT

In the construction of a bass range clarinet having a tubular body with an axial hole for air column vibration and tone holes for sound wave emanation, an additional radial hole is provided in communication with the axial hole to reduce sound wave reflection by an open pad for controlling the condition of each tone hole, thereby assuring generation of a brilliant and clarion tones.

2 Claims, 3 Drawing Sheets

KEY MECHANISM FOR A BASS RANGE CLARINET

BACKGROUND OF THE INVENTION

The present invention relates to an improved key mechanism for a bass range clarinet, and more particularly relates to improvements in construction of a key mechanism for controlling tone generation by a bass range clarinet such as an alto clarinet, a bass clarinet, a contraclarinet or a basset horn.

A bass range clarinet is a sort of wood wind made of granadilla or the like and in general is in the form of a long tubular body. An axial hole for air column vibration is formed through the tubular body in communication with surrounding air via radial tone holes formed at prescribed positions along the length of the tubular body and tone generation via each tone hole is controlled by an associated key mechanism arranged on the tubular body. More specifically, the key mechanism includes a key corresponding to a tone hole. The key is mechanically linked to a pad arm via a key post secured to the tubular body near the tone hole and a pad means is swingably carried by the pad arm. The pad means is spring loaded to normally open the tone hole and closes the tone hole when the key is manually operated in order to adjust the length of the air column to be generated in the axial hole.

When compared with brasses, tone holes in a bass range clarinet are smaller in dimension. In addition, the pad is allowed to swing only over a limited angle. That is, even in an open state of a tone hole, the associated pad is located just above the open tone hole. Thus, at tone generation under this condition, the sound wave is reflected by the face of the pad back into the axial hole in the tubular body and poses ill influence on the air column vibration. In other words, the peak frequency of the air column vibration is much disturbed by the reflected sound wave, thereby degrading sound emanation of the bass range clarinet while allowing generation of gloomy tones.

With the conventional key mechanism, sound emanation is much degraded in the case of an A/E note, a Bb/F note and a B/F# note. Such notes are accompanied with a mode quite like the so-called throat tones. Tone holes for such notes are located quite close to the throat of a bass clarinet whereat the air column vibration can hardly be stabilized. Such throat tones are very sonant and also poor in sound emanation.

SUMMARY OF THE INVENTION

It is the basic object of the present invention to improve sound emanation of a bass range clarinet and to enable generation of brilliant tones.

It is another object of the present invention to improve the tone quality of an A/E note, a Bb/F note and a B/F# note.

In accordance with the first basic aspect of the present invention, a through hole is formed in a pad means of a key mechanism.

In accordance with the second basic aspect of the present invention, an auxiliary smaller hole is radially formed in the vicinity of a tone hole and an auxiliary pad means for the auxiliary hole is coupled in operation to a pad means for the tone hole.

DESCRIPTION OF THE PREFERRED EMBODIMENTS

One embodiment of the key mechanism in accordance with the first aspect of the present invention is shown in Figs.1 to 4, in which a tubular body 21 of a bass range clarinet is provided with an axial hole 23 for air column vibration. At a prescribed position along the length of the tubular body 21 corresponding to a certain note, is formed a tone hole 25 in radial communication with the axial hole 23. Generally, the tone hole 25 is equal to or smaller than the axial hole 23 in diameter.

Figure 1:
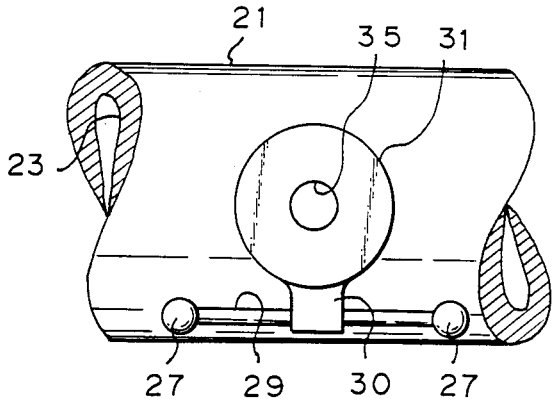
FIG.1 is a plan view of one embodiment of the key mechanism in accordance with the present invention.
Figure 2:
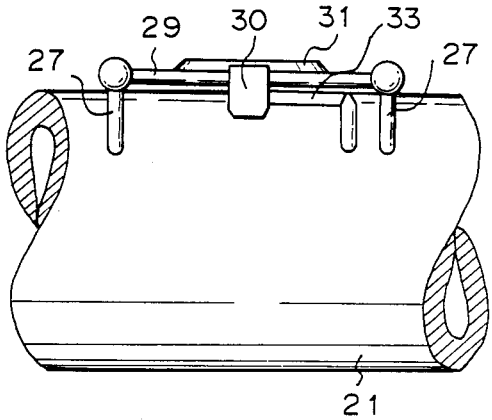
FIG.2 is a front view of the same mechanism.
Figure 3:
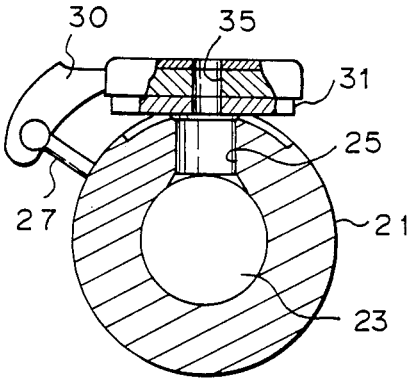
Fig.3 is a transverse cross-sectional view of the same mechanism with a tone hole being closed.
Figure 4:
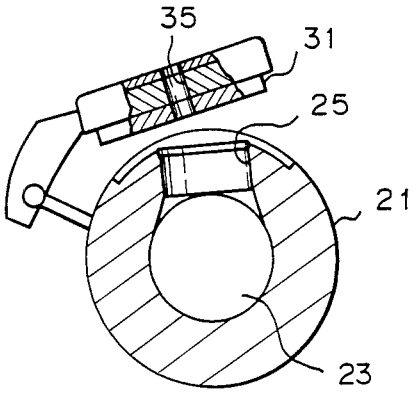
Fig.4 is a transverse cross-sectional view of the same mechanism with the tone hole being opened.

A pair of key posts 27 are secured to the tubular body 21 in the vicinity of the tone hole 25 and bridged by a key rod 29. A pad means 31 including a pad and a pad cup is swingably coupled to the key rod 29 via a pad arm 30 for controlling the state of the tone hole 25. A needle spring 33 is attached to the pad arm 30 in order to urge the pad means 31 to normally open the tone hole 25. As shown in Fig.4, the pad means 31 is held at a prescribed angular position with respect to the open end of the tone hole 25. For convenience in performance, the angular position is chosen so that only a small gap should be left between the open pad means 31 and the open end of the tone hole 25. Such an angular position is chosen for convenience in player's finger operation during performance.

A through hole 35 is formed about the center of the pad means 31, i.e. the pad and pad cup and has a dimension such that it can be fully covered by the player's finger.

When the pad means 31 is operated by the player's finger, for closure of the tone hole 25, the through hole 35 is also closed and the effective length of the air column vibration in the axial hole 23 changes. Since the air column vibration is directly perceived by the player's finger, the player can well adjust the subtle nuance of performance on the basis of the feeling on the finger. For example, vibration, tone colour and musical interval of each tone generated can be freely adjusted.

When the pad means 31 is unoperated to leave the tone hole 25 open as shown in Fig.4, a sound wave is emanated via the tone hole 25 and, despite the specified angular position of the pad means 31, its reflection is much reduced thanks to escape via the through hole 35 in the pad means 31. As a consequence, ill influence on the air column vibration in the axial hole 23 is much reduced and the peak frequency of the air column vibration little disturbed by sound wave reflection. Thus, the sound emanation of the bass range clarinet is much improved while enabling generation of brilliant tones.

Figure 5:
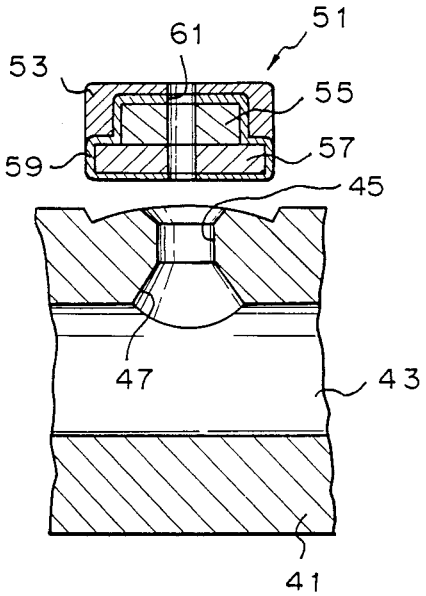
Fig.5 is a sectional view of another embodiment of the key mechanism in accordance with the present invention.

Another embodiment of the key mechanism in accordance with the first aspect of the present invention is shown in FIG.5. In the case of this embodiment, a tubular body 41 of a bass range clarinet is provided with an axial hole 43 for air column vibration. At a prescribed position along the length of the tubular body 41 corresponding to a certain note, is formed a tone hole 45 in radial communication with the axial hole 43 via a funnel-shaped undercut 47. A pad means 51 for the tone hole 45 is made up of a circular cardboard 55, a circular compressed felt 57 bonded face to face to the cardboard 55, an animal bladder 59 tightly embracing the cardboard 55 and the felt 57, a pad cup 53 partly encasing and bonded to the bladder 59 and a through hole 61 formed about the center of the pad means 51. The through hole 61 has a dimension such that it can be fully covered by the player's finger. Though omitted in the drawing, such a pad means 51 is mounted to the tubular body 41 as in the embodiment shown in FIGS. 1 to 4.

Figure 6:
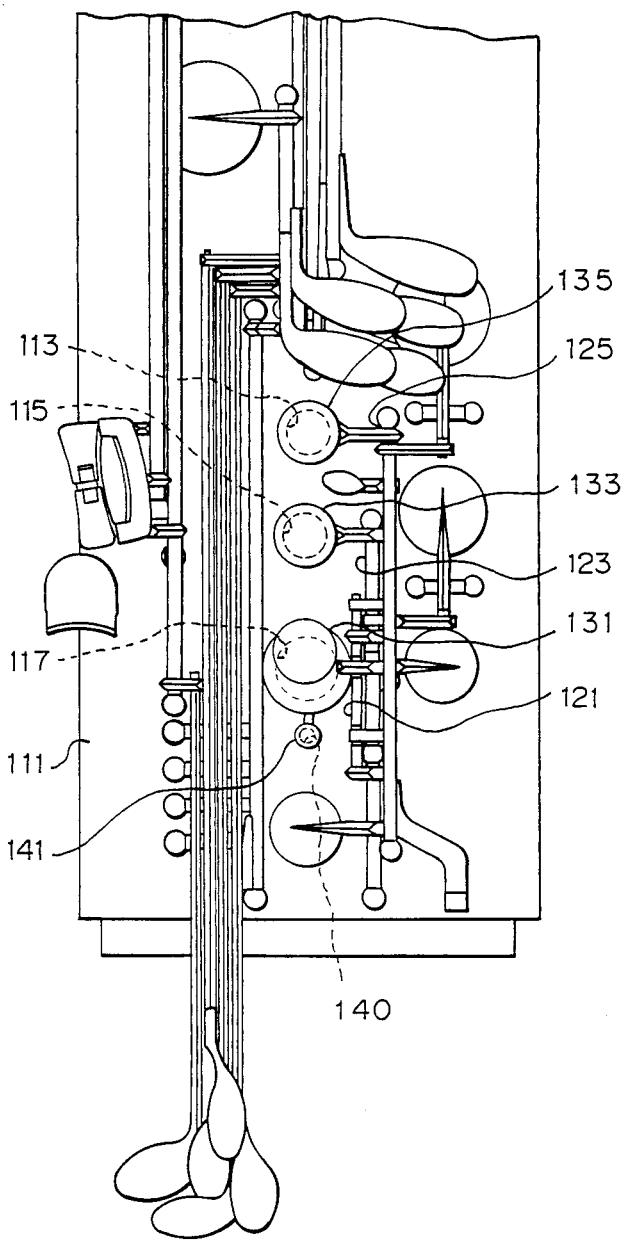
Fig.6 is a front view of the other embodiment of the key mechanism in accordance with the present invention.

One embodiment of the key mechanism in accordance with the second aspect of the present invention is shown in Fig.6, in which the key mechanism of the present invention is arranged on the lower joint 111 of a bass range clarinet. Near the end for connection with the upper joint (not shown), the lower joint is provided with 3 sets of tone holes 113, 115 and 117 formed in spaced alignment.

The conditions of these tone holes 113, 115 and 117 are independently controlled by pad means 135, 133 and 131 swingably mounted to the lower joint 111 by means of key rods 125, 123 and 121, respectively. Different fingers are used for operation on different pads.

The tone hole 113 is used for generation of the A/E tone. That is, the pad means 131 and 133 are made to close the tone holes 117 and 115. As the register key (not shown) is operated, for closing, the A note is generated. As the register key is operated for opening, the E note is generated.

The tone hole 115 is used for generation of the Bb/F note. That is, the pad means 131 is made to close the tone hole 117 and the pad means 133 is made to open the tone hole 115. Closing operation on the register key generates the Bb note, and opening operation on the register key generates the F# note.

The tone hole 117 is used for generation of the B/F# note. That is, the pad means 131 is made to open the tone hole 117 and the pad means 133 is made to close the tone hole 115. Closing operation on the register key generates the B note, and opening operation on the register key generates the F# note.

An auxiliary hole 140 is formed in the lower joint 111 in the vicinity of the tone hole 117 with a smaller dimension. The condition of this auxiliary hole 140 is controlled by an auxiliary pad means 141 which is coupled in one body to the pad means 131 for the tone hole 117. When the pad means 131 is operated for closure of the tone hole 117, the auxiliary pad means 141 concurrently closes the auxiliary hole 140. When the pad means 131 is unoperated for opening of the tone hole 117, the auxiliary pad means 141 concurrently opens the auxiliary hole 140 for increased sound emanation and generation of a clarion tone.

In the case of the embodiment shown in FIGS. 1 to 5, a through hole is formed in a pad means of a key mechanism. Whereas, in the case of the embodiment shown in Fig.6, an auxiliary smaller hole is radially formed in the vicinity of a tone hole and an auxiliary pad means for the auxiliary hole is coupled in operation to a pad means for the tone hole. Combination of these two features on a bass range clarinet enables generation of more brilliant and clarion tones.

I claim:

1. An improved key mechanism for a bass range clarinet having a tubular body with an axial hole for air column vibration comprising a tone hole formed in said tubular body in radial communication with said axial hole, pad means disposed for operative association with said tone hole on said tubular body, an auxiliary hole formed in said tubular body adjacent said tone hole, said auxiliary hole being smaller in dimension than said tone hole, auxiliary pad means disposed for operative association with said auxiliary hole , said auxiliary pad means being fixedly attached to said pad means for movement therewith, and means for moving said pad means with said auxiliary pad means between a first position wherein said tone hole is closed by said pad means and said auxiliary tone hole is closed by said auxiliary pad means, and a second position wherein said tone hole and said auxiliary hole are open.

2. An improved key mechanism as claimed in claim 1 in which said moving means includes spring means attached to said pad means to force said pad means and said auxiliary pad means into said second position, and link means connecting said pad means to key means operatively associated with said pad means, wherein upon the operation of said key means said pad means will be moved to said first position.

* * * * *